US005313667A

United States Patent [19]

Levine

[11] Patent Number: 5,313,667

[45] Date of Patent: May 24, 1994

[54] SNOWBOARD WRIST PROTECTOR

[76] Inventor: Norman D. Levine, P.O. Box 1867, Pompano Beach, Fla. 33061

[21] Appl. No.: 810,493

[22] Filed: Dec. 19, 1991

[51] Int. Cl.[5] ..... A41D 13/08

[52] U.S. Cl. ..... 2/16; 2/160; 2/162

[58] Field of Search ..... 2/161 A, 16, 20, 162, 2/160, 167, 168, 170; 273/188 R, 189 R, 54 B; 602/21; 128/878

[56] References Cited

U.S. PATENT DOCUMENTS

| | | | |
|---|---|---|---|
| 2,751,598 | 6/1956 | Romeo | 2/161 A |
| 3,512,776 | 5/1970 | Thomas, Sr. | 2/161 A X |
| 3,707,730 | 1/1973 | Slider | 2/161 A |
| 3,728,738 | 4/1973 | Andolino | 2/161 A |
| 4,138,108 | 2/1979 | Robinson | 2/161 A X |
| 4,198,709 | 4/1980 | Clayton | 2/161 A |
| 4,228,548 | 10/1980 | Cohen | 2/161 A |
| 4,408,358 | 10/1983 | Swan | 2/161 A |
| 5,014,689 | 5/1991 | Meunchen et al. | 273/54 B |
| 5,058,209 | 10/1991 | Eisenberg | 2/161 A |
| 5,197,149 | 3/1993 | Overton | 2/161 A |

*Primary Examiner*—Clifford D. Crowder
*Assistant Examiner*—Michael A. Neas
*Attorney, Agent, or Firm*—Malin, Haley, DiMaggio & Crosby

[57] ABSTRACT

A wrist pad for protecting the wrist of a snowboard rider from adverse rotation and consequent serious injury. The wrist pad comprises an elastic body portion of nominal thickness generally defined by an inner and outer surface which is bounded by a plurality of elongated side edges, said body portion having integral means for lending structural rigidity to the entire pad assembly, said structural rigidity means comprising an elongated semi-rigid support member having a profile approximating the wrist-hand junction of a wearer, and a plurality of opposing flaps and straps having alternate faces of hook and loop material respectively, thereby forming a releasably securable structure around said wearer's wrist.

11 Claims, 2 Drawing Sheets

SNOWBOARD WRIST PROTECTOR

BACKGROUND OF THE INVENTION

1. Field of the Invention

This invention relates generally to protective gear for snowboard riders, and more particularly, to a wrist pad to be worn by a snowboard rider which forms a rigid and protective support around the wrist area of the wearer, thereby preventing the likelihood of serious wrist injuries which can be sustained during a fall.

2. Description of the Prior Art

Snowboarding is presently the fastest growing alpine winter sport in the United States. With a greater number of national ski areas permitting snowboarders to share the same lift serviced terrain as downhill skiers, the number of active participants has mushroomed, particularly in the under 25 years of age group. Snowboarding is analogous to "surfing on the snow". The snowboarder typically wears either "soft-shell" or "rigid-shell" boots, similar to that used with downhill ski equipment, either of which are rigidly secured to a pair of plate bindings, the forward one disposed axially and the rear one disposed transverse on the upper surface of the snowboard. Unlike downhill ski equipment which utilizes releasable bindings that are actuated upon the skier's leg encountering a given twisting or pulling load during a fall, snowboard bindings do not release unless manually activated by the snowboarder when removal of the board is desired. Consequently, the snowboard is always anchored to the rider's feet during use. The reason for the design discrepancy between downhill ski equipment and snowboards is apparent in the geometry of the equipment. Skis are typically elongated, having a very high aspect ratio, i.e., the length of the ski proportion in to its width. Thus, when a skier falls, the long ski length facilitates the generation of a large torque or twisting moment at the interface between the skier's boot and the ski, which if not eliminated by release of the boot from the ski, can easily result in serious leg injuries. Moreover, each ski may be following a mutually exclusive path of travel during a fall. In contrast, because a snowboard has a relatively short aspect ratio, and since both legs are attached to one board, the type of falls encountered by a snowboarder are markedly different from those a downhill skier may face. Thus, the likelihood of leg injuries due to twisting such as typically encountered in downhill skiing are not a real concern. Unfortunately, the snowboarder must contend with a different type of fall, one which results in the rider falling forward upon his or her knees and arms, and the other, in which the rider falls over backwards upon his or her posterior. It is this first type of fall, which can result in serious injuries to an unsupported or unprotected wrist, to which the instant invention is directed.

There is no protective wear presently available on the market which is capable of providing a snowboard rider with a rigid protective pad which may be comfortably worn while riding, yet which affords the rider a maximum degree of protection from wrist injuries.

SUMMARY OF THE INVENTION

The present invention discloses a wrist pad to be worn by a snowboard rider which reduces the likelihood of serious wrist injuries by providing a firm support structure which is adapted to fit firmly over a wearer's wrist. The wrist pad comprises: a body portion of nominal wall thickness which is wrapped entirely around the wrist area of the wearer, means for imparting structural rigidity to the body portion so as to form a rigid support along the upper region of the wrist, and means for releasably securing the body portion in place.

The body portion is preferably fabricated from neoprene or an equivalent waterproof elastic material having similar properties. Accordingly, the elastic properties provide control of the tightness and rigidity of the entire structure. It is a structure having an inner and outer surface which is bounded by a plurality of elongated side edges, geometrically oriented to define integral flaps which function as a means of securing the body portion to the wrist area. The body portion has an aperture defined normal therethrough near one side edge through which the thumb of the wearer may pass, and strap means adjacent said aperture to rigidly secure the thumb against the body portion to preclude the thumb from any outward movement or rotation which could cause serious injuries.

An elongated patch is rigidly attached to the outer surface of the body portion which forms a "pocket" into which a molded support member having a profile approximating the wrist-hand junction of a human arm may be placed. The support member may be fabricated by injection molding or similar means, and may have varying degrees of axial profile to comfortably suit the user. The support should be semi-flexible and of ample longitudinal stiffness, which may be varied depending on the age or size of the wearer, such that the wrist is prevented from "snapping" rearward during a fall. The body portion is designed to fit over a glove worn by the rider during use, which assists in forming a snug, shock proof protective structure around the entire wrist area.

To afford the user quick and easy operation, the wrist pad has simple quick release means which comprise alternate hook and loop material on the inner surface of the aforementioned body portion flaps, and the opposing outer surface of the body portion respectively. An additional elongated strap having hook and loop material on patches disposed on alternative sides, is also provided such that the entire pad maintains a tight, solid fit around the wrist area.

In accordance with the instant invention, it is an object thereof to provide a wrist pad for protecting the wrist area of a snowboard rider from serious injury.

It is a further object of the present invention to provide a wrist pad fabricated from an elastic material which includes means for lending rigid support and stability to the entire pad structure.

It is still another object of the instant invention to provide a wrist pad which is economical to manufacture, easy to utilize, and comfortable to wear.

In accordance with these and other objects which will become apparent hereinafter, the instant invention will now be described with particular reference to the accompanying drawings.

DETAILED DESCRIPTION OF THE PREFERRED EMBODIMENT

Figure 1:
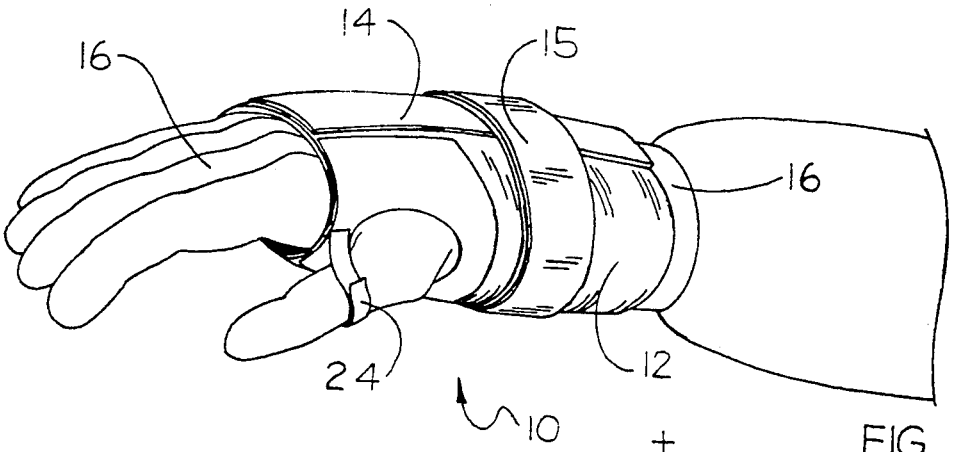
FIG. 1 is an isometric view of the wrist pad being worn around a wearer's wrist.

With reference to the several views of the drawings, there is depicted a wrist pad protector generally denoted by the reference numeral 10, which comprises a body portion 12, means for imparting structural rigidity 14 to body portion 12, and means for releasably securing 15 body portion 12 to a wearer's wrist-hand junction generally referred to in FIG. 1 as 16.

Figure 2:
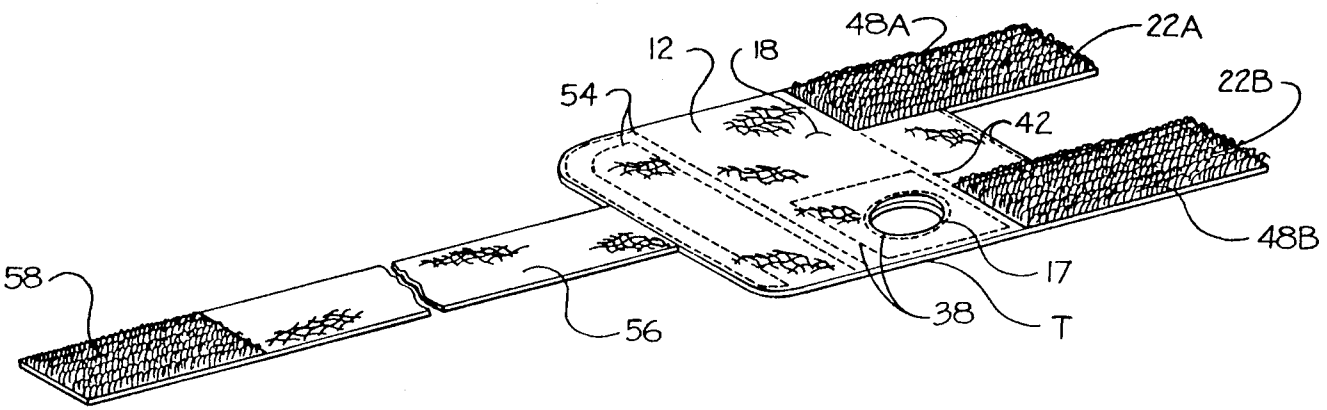
FIG. 2 is an isometric view of the first side of the wrist pad assembly.
Figure 3:
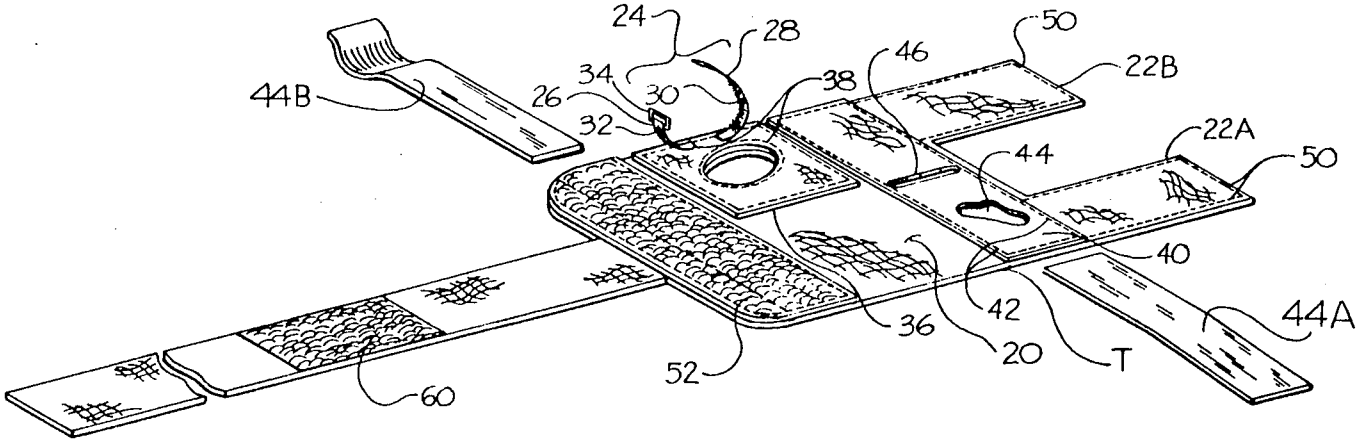
FIG. 3 is a isometric view of the second side of the wrist pad assembly.

FIGS. 2 and 3 depict isometric views of the first (inner) 18 and second (outer) 20 side of body portion 12 respectively. Body portion 12 is preferably fabricated from a waterproof, elastic material such as neoprene and is defined by first side 18 and second side 20, both of which form a nominal thickness T therebetween. Body portion 12 is bounded by a plurality of elongated side edges, geometrically disposed so as to form a pair of flaps 22 (*a*) and 22 (*b*) respectively, for purposes to be discussed hereinbelow. Body portion 12 has an aperture 17 therethrough normal to first and second sides 18 and 20 respectively, and adjacent one side edge through which the thumb of the wearer may pass. Strap means 24 are provided such that the thumb may be rigidly secured external to body portion 12 to prevent thumb rotation outward from wrist pad 12 which could potentially result in serious injuries. (See FIGS. 1 and 2).

Strap means 24 are generally comprised of opposing straps 26 and 28 respectively, each having patches of hook material 30 and loop material 32 on opposite sides respectively, and buckle 34 secured to the end of strap 26. Straps 26 and 28 may be fabricated from individual segments of strap material and stitched separately to body portion second side 20, or may be constructed from a single piece of material and anchored to body portion second side 20 by a slotted rectangular patch of suede 36 having slots 38 as depicted in FIG. 3. Patch 36 also serves to structurally reinforce the area around aperture 17, and is attached to body portion 12 by stitching 38.

Figure 6:
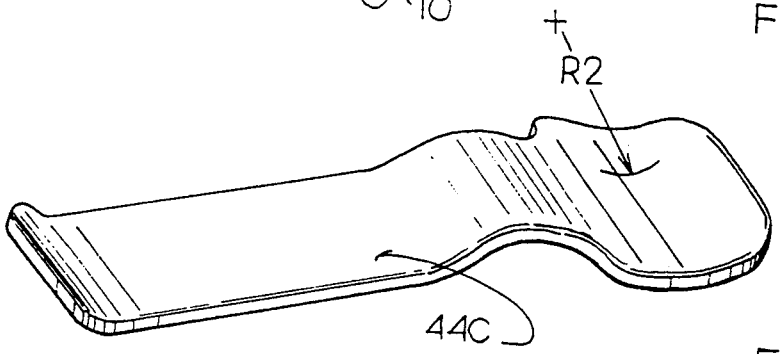
FIG. 6 is an isometric view of another embodiment of the semi-rigid support member.
Figure 4:
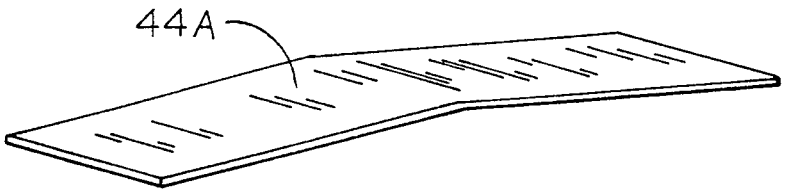
FIG. 4 is an isometric view of one embodiment of the rigid support member.
Figure 5:
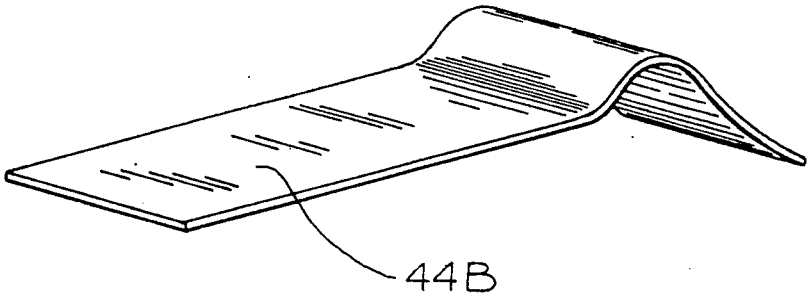
FIG. 5 is an isometric view of an alternative embodiment of the rigid support member.

FIG. 3 depicts means for imparting structural rigidity 14 to body portion 12, which comprises an elongated neoprene patch 40 which is rigidly attached to body portion 12 by stitching 42 about the external periphery thereof. Patch 40 forms a hollow cavity when attached to body portion 12, wherein rigid support member 44*a* may be disposed. Support member 44*a* is a generally elongated angular planar member having a variable profile of angle $\theta$ which approximates the wrist-hand junction of a human arm as shown in FIG. 4. In the alternative embodiment depicted in FIG. 5, support member 44*b* is shown having a more exaggerated profile of angle $\beta$, and further having an arcuate portion of radius R, which may provide the user with greater comfort depending upon his or her preference. In yet another embodiment, as depicted in FIG. 6 support member 44*c* is depicted having a "spoon-like" portion of radius R2. Support members 44*a*, 44*b*, and 44*c* may be fabricated from injection molded plastic, or equivalent materials, and may be alternatively constructed from metal within the scope of the invention. The support members should be semi-rigid, and of ample longitudinal stiffness such that the wrist is constrained from adverse rotation during a fall. Depending on whether the wrist protector 10 is to be used by a child or adult, the stiffness of the support member may be altered to best suit the user. Patch 40 has slot 46 as shown in FIG. 3, to facilitate easy installation and removal of support members 44*a*, 44*b* or 44*c*.

Means for releasably securing 15 body portion 12 to the wearer's wrist comprise a pair of flaps 22*a* and 22*b* integrally formed in body portion 12, each respectively having hook patches 48*a* and 48*b* rigidly secured to first side 18 by peripheral stitching 50, and patch 52 of loop material attached to second side 20 along stitch lines 54 defining a cavity (not shown) for insertion of a second rigid support member 44*b*. An elongated planar strap member 56 is rigidly attached to body portion 12 at the end opposite flaps 22*a* and 22*b*. Strap 56 has hook patch 58 and loop patch 60 disposed on opposing faces of strap 56 respectively. It is important to note that in lieu of the aforementioned stitch lines, all patches may be secured to body portion 12 by alternative methods such as bonding, without departing from the scope of the invention.

To utilize wrist pad 10, the wearer straps first side 18 of body portion 12 around his or her wrist subsequent to placing a thumb through aperture 17. Patches 22*a* and 22*b* are folded over patch 52, thereby allowing the opposing hook and loop material patches to engage, thereby securing body portion 12 around the wearer's wrist. By wrapping elongated strap member 56 around the external periphery of second side 20, and folding the hook patch 58 onto loop patch 60, the entire pad assembly 10 forms a snug fit around the wearer's wrist, which when worn around a glove or mitten, will preclude any possible adverse rotation of the wrist and prevent serious injuries during a fall.

The instant invention has been shown and described herein in what is considered to be the most practical and preferred embodiment. It is recognized, however, that departures may be made therefrom within the scope of the invention, and that obvious modifications will occur to a person skilled in the art.

What I claim is:

1. A wrist pad for protecting the wrist area of a wearer, comprising:

a body portion having first and second sides which define a nominal wall thickness therebetween, bounded by a plurality of elongated side edges, said body portion further defining an aperture therethrough normal to said first and second sides to accommodate the thumb of said wearer, wherein said body portion adds additional support to the wearer's wrist;

means for imparting structural rigidity to said body portion attached thereto, said means for imparting structural rigidity including a first semi-rigid support member disposed such that it lies adjacent the back of the hand and wrist, respectively;

a second semi-rigid support member disposed such that it lies adjacent the palm of the hand and wrist, respectively;

strap means disposed adjacent said aperture for securing the thumb of said wearer to said body portion, said strap means substantially preventing any outward movement or rotation of the thumb; and means for releasably securing said body portion to said wearer's wrist, said means for releasably securing including an elongated planar strap member attached to said body portion and extending outward therefrom, said strap member having hook and loop material disposed on opposing faces, said elongated strap capable of being wrapped around the entire external periphery of said second side at least once, whereby, when said wrist pad is being used, said body portion first side can be maintained in intimate contact with a snow glove being worn on said wrist by wrapping said body portion entirely around said wrist such that said body portion and means for imparting structural rigidity form a solid structure around said wrist area, thereby shielding said wrist from injurious falls.

2. The wrist pad recited in claim 1, wherein said means for releasably securing further includes:

at least one flap integrally formed in said body portion, said flap having hook material attached to said first side; and loop material attached to said body portion second side disposed transverse to said flap.

3. The wrist pad recited in claim 1, wherein said body portion is fabricated from a waterproof elastic material.

4. The wrist pad recited in claim 1, wherein said means for imparting structural rigidity further includes:

an elongated first patch attached to said second side of said body portion along the peripheral edge of said first patch, whereby a hollow cavity is defined between said body portion second side and said first patch;

wherein said first semi-rigid support member is disposed within said hollow cavity, said first semi-rigid support member having a profile approximating the wrist-hand junction of a human arm; and a second elongated patch attached to said second side of said body portion along the peripheral edge of said second patch, wherein a second hollow cavity is defined between said body portion second side and said second patch, wherein said second semi-rigid support member is disposed within said second hollow cavity.

5. The wrist pad recited in claim 4, wherein said elongated first patch is fabricated from an elastic material.

6. The wrist pad recited in claim 4, wherein said second patch is fabricated from suede.

7. The wrist pad recited in claim 4, wherein said first semi-rigid support member is an elongated planar structure of nominal thickness defined by two intersecting planes at an obtuse angle therebetween.

8. The wrist pad recited in claim 4, wherein said second semi-rigid support member is defined by the arcuate intersection of two planar segments at an obtuse angle therebetween.

9. A wrist pad for protecting the wrist area of a wearer, comprising:

a waterproof elastic body portion having first and second sides which define a nominal wall thickness therebetween, bounded by a plurality of elongated side edges, said body portion further defining an aperture therethrough normal to said first and second sides to accommodate the thumb of said wearer, said body portion second side having a suede patch of nominal thickness attached thereto, and disposed adjacent said aperture, said body portion second side further having strap means disposed adjacent said aperture for securing said thumb of said wearer to said body portion, said strap means substantially preventing any outward movement or rotation of the thumb, said strap means secured to said body portion by said suede patch, wherein said body portion adds additional support to the wearer's wrist;

means for imparting structural rigidity to said body portion attached thereto, wherein said means for imparting structural rigidity comprises a first elongated elastic patch attached to said second side of said body portion along the peripheral edge of said first elastic patch, wherein a first hollow cavity is defined between said body portion second side and said first patch;

a first semi-rigid support member disposed within said first cavity, said first semi-rigid support member having a profile approximating the wrist-hand junction of a human arm, said first semi-rigid support member disposed such that it lies adjacent the back of the hand and wrist respectively;

a second elongated patch attached to said second side of said body portion along the peripheral edge of said second patch, wherein a second hollow cavity is defined between said body portion second side and said second patch;

a second semi-rigid support member disposed within said second cavity, said second semi-rigid support member disposed such that it lies adjacent the palm of the hand and wrist respectively; and means for releasably securing said body portion to said wearer's wrist, said means for releasably securing comprising at least one flap integrally formed in said body portion having hook material attached to said first side; loop material attached to said body portion second side disposed transverse to said flap; and an elongated planar strap member attached to said body portion and extending outward therefrom, said strap member having hook and loop material disposed on opposing faces, said elongated strap member capable of being wrapped around the entire external periphery of said second side at least once, said elongated strap member thereby securing each of said first and second semi-rigid support members in place, whereby, when said wrist pad is being used, said body portion first side can be maintained in intimate contact with a snow glove being worn on said wrist by wrapping said body portion entirely around said wrist such that said body portion and rigid support member form a solid structure around said wrist area, thereby shielding said wrist from injurious falls.

10. The wrist pad recited in claim 9, wherein said first semi-rigid support member is an elongated planar structure of nominal thickness defined by two intersecting planes at an obtuse angle therebetween.

11. The wrist pad recited in claim 9, wherein said second semi-rigid support member is defined by the arcuate intersection of two planar segments at an obtuse angle therebetween.

* * * * *